US010774625B2

(12) United States Patent
Noui-Mehidi et al.

(10) Patent No.: US 10,774,625 B2
(45) Date of Patent: Sep. 15, 2020

(54) METHOD OF PRODUCING FROM A HYDROCARBON BEARING ZONE WITH LATERALS EXTENDING FROM AN INCLINED MAIN BORE

(71) Applicant: Saudi Arabian Oil Company, Dhahran (SA)

(72) Inventors: Mohamed Nabil Noui-Mehidi, Dhahran (SA); Fakuen Frank Chang, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 177 days.

(21) Appl. No.: 15/875,091

(22) Filed: Jan. 19, 2018

(65) Prior Publication Data

US 2019/0226306 A1 Jul. 25, 2019

(51) Int. Cl.

| | |
|---|---|
| ***E21B 43/12*** | (2006.01) |
| ***E21B 41/00*** | (2006.01) |
| ***E21B 43/30*** | (2006.01) |
| ***E21B 33/035*** | (2006.01) |
| ***E21B 34/06*** | (2006.01) |
| ***E21B 34/16*** | (2006.01) |
| ***E21B 43/14*** | (2006.01) |
| *E21B 47/12* | (2012.01) |

(52) U.S. Cl.

CPC ..... *E21B 43/12* (2013.01); *E21B 33/0355* (2013.01); *E21B 34/066* (2013.01); *E21B 34/16* (2013.01); *E21B 41/0035* (2013.01); *E21B 43/14* (2013.01); *E21B 43/30* (2013.01); *E21B 47/12* (2013.01)

(58) Field of Classification Search

CPC .... E21B 33/0355; E21B 34/066; E21B 34/16; E21B 43/12; E21B 43/14; E21B 47/12; E21B 43/30; E21B 41/0035

See application file for complete search history.

(56) References Cited

U.S. PATENT DOCUMENTS

| | | | |
|---|---|---|---|
| 3,369,605 | A | 2/1968 | Donaldson et al. |
| 5,101,898 | A | 4/1992 | Hong |

(Continued)

FOREIGN PATENT DOCUMENTS

| | | | |
|---|---|---|---|
| EP | 2884042 | A1 | 6/2015 |
| WO | 2004007906 | A1 | 1/2004 |
| WO | 2013061065 | A2 | 5/2013 |

OTHER PUBLICATIONS

International Search Report and Written Opinion for related PCT application PCT/US2019/014103 dated Jul. 12, 2019.

*Primary Examiner* — Robert E Fuller
*Assistant Examiner* — Christopher J Sebesta
(74) *Attorney, Agent, or Firm* — Bracewell LLP; Constance G. Rhebergen; James E. Bradley

(57) ABSTRACT

A main bore is drilled with an inclined section extending toward a hydrocarbon bearing earth formation. First and second laterals are drilled from the inclined section downward into the formation at a steeper angles than the inclined section. The first lateral is opened to the formation at a depth greater than a depth of an opening of the second lateral. After completion, well fluid flows through the openings in the first and second laterals into the inclined section of the main bore. In response to an increasing water content in the well fluid flowing up the main bore, the flow of well fluid from the first lateral is restricted.

15 Claims, 3 Drawing Sheets

(56) References Cited

U.S. PATENT DOCUMENTS

| | | | | |
|---|---|---|---|---|
| 7,048,049 | B2 * | 5/2006 | Zupanick | E21B 43/006 166/245 |
| 7,243,738 | B2 | 7/2007 | Gardes | |
| 7,866,414 | B2 | 1/2011 | Patel | |
| 8,099,266 | B2 | 1/2012 | Burge et al. | |
| 9,506,325 | B2 | 11/2016 | Fould et al. | |
| 2006/0048946 | A1 * | 3/2006 | Al-Muraikhi | E21B 43/08 166/369 |
| 2011/0005762 | A1 * | 1/2011 | Poole | E21B 43/305 166/313 |
| 2011/0192596 | A1 | 8/2011 | Patel | |
| 2014/0198617 | A1 * | 7/2014 | Noui-Mehidi | E21B 47/04 367/81 |
| 2014/0360723 | A1 * | 12/2014 | Utter | E21B 29/06 166/298 |
| 2016/0177685 | A1 | 6/2016 | Frederick et al. | |
| 2016/0194937 | A1 | 7/2016 | Myhre et al. | |
| 2016/0258277 | A1 | 9/2016 | Bittar et al. | |
| 2016/0312584 | A1 * | 10/2016 | Hazel | E21B 41/0035 |

* cited by examiner

METHOD OF PRODUCING FROM A HYDROCARBON BEARING ZONE WITH LATERALS EXTENDING FROM AN INCLINED MAIN BORE

BACKGROUND

1. Field

The present disclosure relates to producing oil from a well, and particularly to a method employing multiple laterals extending downward to an oil bearing formation from an inclined section of a main well bore.

2. Description of Prior Art

Oil may be found in thin formations or zones that overlie a water containing formation. Typically, one or more wells will be drilled into the oil bearing zone. After the well is completed, well fluid from the oil bearing zone flows into the lower part of the well and to the surface.

As the well fluid depletes oil from the oil bearing formation, water from the water bearing zone will encroach into the oil bearing zone, increasing the water content of the well fluid flowing up the well. Eventually, the water encroachment will reach a level that results in too much water flowing up the well. Various techniques may then be required to workover the well.

SUMMARY

A method of wellbore operations comprises drilling a main bore with an inclined section extending toward an earth formation. First and second laterals are drilled from the inclined section, each extending downward from the inclined section into the formation. Openings are provided in the laterals, the opening in the first lateral extending to a greater depth than the opening in the second lateral. Well fluid flows through the openings in the laterals into the inclined section of the main bore. In the event a water content in the well fluid flowing from the opening in the first lateral exceeds a water content in the well fluid flowing from the second lateral by a selected amount, the flow through the opening of the first lateral is selectively restricted relative to the flow from the opening of the second lateral.

Drilling the first and second laterals comprises inclining the laterals at a greater angle relative to horizontal than the inclined section of the main bore.

Drilling the first and second laterals comprises spacing the first and second laterals apart from each other along a length of the inclined section.

In the embodiment shown, drilling first and second laterals comprises inclining each of the laterals at an angle in a range from 45 to 90 degrees relative to horizontal.

In one embodiment, drilling first and second laterals comprises positioning an axis of each of the first and second laterals in a vertical plane.

Drilling the main bore may comprise blocking the inclined section from a direct entry of well fluid from the formation.

In the embodiment shown, the first lateral joins the inclined section at a point closer to an upper end of the main bore than the second lateral.

An inflow control device may be installed in the first lateral above the opening in the first lateral. If so, selectively restricting the flow through the opening of the first lateral comprises actuating a valve in the inflow control device.

In another embodiment, selectively restricting the flow through the opening of the first lateral comprises sealing at least a lower portion of the opening in the first lateral.

The method of wellbore operations may also comprise drilling a main bore with an inclined section extending toward but not opening into a hydrocarbon containing earth formation. A first lateral is drilled from a first junction with the inclined section downward from the inclined section into the formation at a steeper angle than the inclined section. An opening to the formation is provided in the first lateral at a first selected depth. A second lateral is drilled from a second junction with the inclined section downward from the inclined section into the formation at a steeper angle than the inclined section. An opening to the formation is provided in the second lateral to a second selected depth that is shallower than the first selected depth. The second junction is farther from an upper end of the main bore than the first junction. Well fluid flows into the first and second laterals, and from the first and second laterals into the inclined section of the main bore. In response to an increasing water content in the well fluid flowing up the main bore, the flow of well fluid from the first lateral into the inclined section of the main bore is restricted.

An inflow control device may be installed in the first lateral. Restricting the well fluid flowing from the first lateral comprises adjusting a valve in the inflow control device.

Adjusting the valve in the inflow control device may comprise lowering a tool on a line into the inclined section of the main bore to a position adjacent the inflow control device. A signal is transmitted from the tool to the inflow control device.

Alternately, restricting the well fluid flowing from the first lateral comprises installing a seal in the first lateral.

Optionally, an upper opening may be provided in the first lateral above the seal, allowing well fluid to flow from upper opening in the first lateral.

Drilling first and second laterals may comprise inclining each of the laterals at an angle in a range from 45 to 90 degrees relative to horizontal.

The method of wellbore operations may also comprise drilling a main bore with an inclined section extending toward an earth formation. First, second and third laterals may be drilled from the inclined section, each of the first, second and third laterals extending downward from the inclined section at a steeper angle than the inclined section. Openings to the formation are provided in the first, second and third laterals. The opening in the first lateral is at a greater depth than the opening in the second lateral. The opening in the second lateral is at a greater depth than the opening in the third lateral. Well fluid flows from the formation through the openings in the first, second and third laterals into the inclined section of the main bore. Any flow of well fluid from the formation directly into the inclined section of the main bore may be prevented. In response to a water content of the well fluid flowing up the main bore, at least a lower portion of the opening in the first lateral may be restricted, and flow through the openings in the second and third laterals into the inclined section of the main bore may be continued. In response to a subsequent water content of the well fluid flowing up the main bore, at least a lower portion of the opening of the second lateral may be restricted, and flow through the opening in the third lateral into the inclined section of the main bore may be continued.

The first, second and third laterals have first, second and third junctions, respectively, with the inclined section. The first junction is shallower than the second junction, and the second junction is shallower than the third junction.

Inflow control devices may be installed in the first lateral and in the second lateral. Flow is restricted through the opening in the first lateral by adjusting a valve in the inflow control device in the first lateral. Flow is restricted through the opening in the second lateral by adjusting a valve in the inflow control device in the second lateral.

Alternately, flow through the opening in the first lateral may be restricted by installing a seal in the first lateral, blocking the opening in the first lateral.

Optionally, an upper opening may be provided in the first lateral above the seal, enabling well fluid to flow through the upper opening into the first lateral.

In one embodiment, a well configuration comprises a main bore with an inclined section extending toward an earth formation. First and second laterals each extend downward from the inclined section into the formation. The first lateral has an opening to the earth formation and the second lateral has an opening to the same earth formation. The opening of the first lateral is at a greater depth than the opening of the second lateral. The openings enable well fluid to flow into the laterals and from the laterals into the inclined section of the main bore.

In one embodiment, each of the first and second lateral inclines at a greater angle relative to horizontal than the inclined section of the main bore.

In one embodiment, each of the first and second laterals has an axis in a vertical plane.

The first lateral joins the inclined section uphole from the second lateral in one embodiment.

BRIEF DESCRIPTION OF DRAWINGS

Some of the features and benefits of the present disclosure having been stated, others will become apparent as the description proceeds when taken in conjunction with the accompanying drawings, in which.

Figure 1:
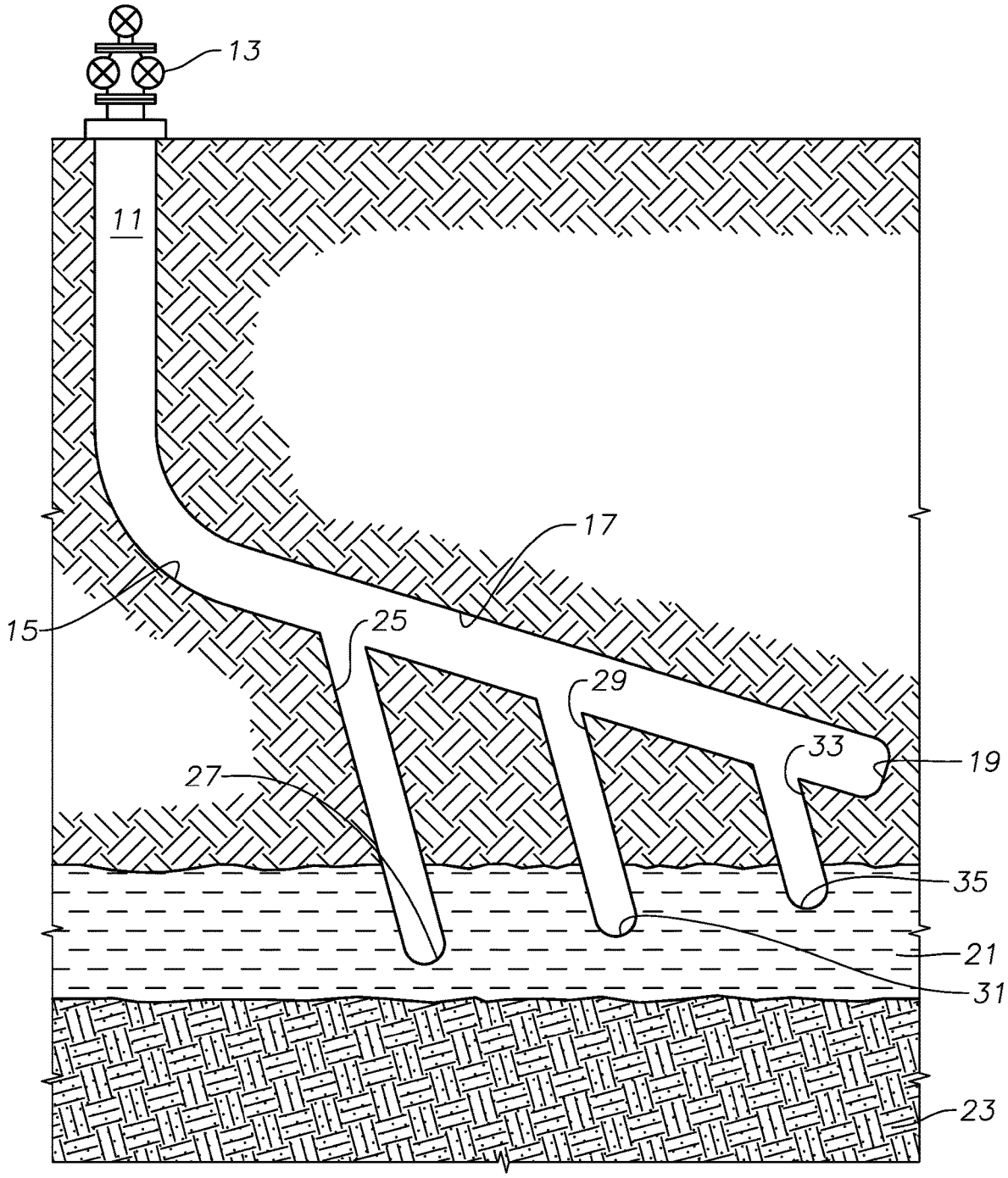
FIG. 1 is a schematic sectional view of an example of laterals extending downward from an inclined section of a main wellbore into a hydrocarbon bearing zone.

While the advantages will be described in connection with disclosed embodiments, it will be understood that it is not intended to be limited to those embodiments. On the contrary, it is intended to cover all alternatives, modifications, and equivalents, as may be included within the spirit and scope as defined by the appended claims.

DETAILED DESCRIPTION

The method and system of the present disclosure will now be described more fully with reference to the accompanying drawings in which embodiments are shown. The method and system of the present disclosure may be in many different forms and should not be construed as limited to the illustrated embodiments set forth; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 schematically illustrates a well having a main bore 11 with a conventional production tree 13 at the upper end. Main bore 11 has a vertical portion extending downward from tree 13 to a curved section or heel 15 that joins an inclined section 17. Inclined section 17 may be straight, but it inclines downward. The angle of inclination of inclined section 17 may vary and is illustrated to be about 10 to 15 degrees relative to horizontal as an example. Main bore 11, including its inclined section 17, may be cased with a casing cemented in place.

Inclined section 17 has a lower end or toe 19 that is schematically shown to be a short distance above an earth formation 21 that is a hydrocarbon or oil bearing zone. Inclined section 17 could extend into oil bearing zone 21, but if so, in this example it is sealed from the well fluid in oil bearing zone 21. Oil bearing zone 21 is illustrated as overlying an earth formation 23 that is a water bearing zone. Oil bearing zone 21 may contain some interspersed water droplets, but it will also have significant quantities of oil at least initially. Water bearing zone 23 will mostly contain water.

Using conventional techniques, the operator drills a first lateral 25 from a first junction with inclined section 17. First lateral 25 is a bore extending downward from inclined section 17 into hydrocarbon bearing zone 21. First lateral 25 may also be straight, but it inclines at a much steeper angle than inclined section 17. As an example, the angle of first lateral 25 relative to horizontal may be 45 to 90 degrees, thus it could be vertical. First lateral 25 has an axis that may be in a vertical plane.

First lateral 25 has an opening 27 schematically illustrated that communicates first lateral 25 with the well fluid in oil bearing zone 21. Opening 27 could be an open hole or uncased portion of lateral 25. Opening 27 could alternately comprise a tubular screen with apertures. First lateral 25 could be completely cased with casing cemented in place and a casing shoe closing the lower end. In that instance, opening 27 would comprise perforations formed in the casing in a conventional manner. The perforations may extend over a length of first lateral 25. Regardless of the configuration of opening 27, its lowest extent, such as its lowest perforation, will be at a selected first depth within oil bearing formation 21. That first depth will be above water bearing zone 23.

A second lateral 29 joins inclined section 17 at a second junction downhole from the junction of first lateral 25 with inclined section 17. Second lateral 29 is also a bore extending downward from inclined section 17 into hydrocarbon bearing zone 21. Second lateral 29 may also be straight and inclining at a much steeper angle than inclined section 17. In this example, second lateral 29 is parallel with first lateral 25, thus it is at an angle relative to horizontal of 45 to 90 degrees. Second lateral 29 has an axis that is in the same vertical plane as first lateral 25 in this embodiment.

Second lateral 29 has an opening 31 that communicates second lateral 29 with the well fluid in oil bearing zone 21. Opening 31 could be an open hole or uncased portion of second lateral 29. Opening 31 could comprise a tubular screen with apertures. Second lateral 29 could be completely cased with casing cemented in place and a casing shoe closing the lower end. In that instance, opening 31 would also comprise a set of perforations made along a length of the casing in second lateral 29 in a conventional manner. Regardless of the configuration of opening 31, its lowest extent, such as its lowest perforation, will be at a selected second depth within oil bearing formation 21 that is shallower than the depth of the lowest extent of opening 27 in first lateral 25. That is, the lowest extent of opening 31 is at a higher level in oil bearing zone 21 than the lowest extent of opening 27 in first lateral 27. The lowest extent of opening 31 is also above water bearing zone 23. The distance from the lowest extent of opening 31 to the junction of second lateral 29 with inclined section 17 is less than the distance from the lowest extent of opening 27 to the junction of first lateral 25 with inclined section 17.

In this example, a third lateral 33 joins inclined section 17 at a junction closer to inclined section lower end 19 than the junction of second lateral 29 with inclined section 17. The junction of third lateral 33 with inclined section 17 is downhole from the junction of second lateral 29 with inclined section 17. Third lateral 33 is also a bore extending downward from inclined section 17 into hydrocarbon bearing zone 21. Third lateral 33 may also be straight, but it also inclines at a much steeper angle than inclined section 17, such as 45 to 90 degrees relative to horizontal. In this example, third lateral 33 has an axis that is parallel with the axes of first lateral 25 and second lateral 29. The axes of first lateral 25, second lateral 29 and third lateral 33 are in the same vertical plane in this embodiment.

Third lateral 33 has an opening 35 that communicates third lateral 33 with well fluid in oil bearing zone 21. Opening 35 could also be an open hole or uncased portion of third lateral 33. Opening 35 could comprise a tubular screen with apertures. Third lateral 33 could be completely cased with casing cemented in place and a casing shoe closing the lower end. In that instance, opening 35 would comprise perforations formed along a length of the casing in a conventional manner. Regardless of the configuration of opening 35, its lowest extent, such as its lowest perforation, will be at a selected third depth within oil bearing formation 21 that is shallower than the depths of the lowest extents of opening 27 in first lateral 25 and opening 31 in second lateral 29. The lowest extent of opening 35 is above water zone 23 and at a higher level in oil bearing zone 21 than the lowest extent of opening 27 in first lateral 25 and opening 31 in second lateral 29. The distance from the lowest extent of opening 35 to the junction of third lateral 33 with inclined section 17 is less than the distance from the lowest extent of opening 31 to the junction of second lateral 29 with inclined section 17.

Figure 2:
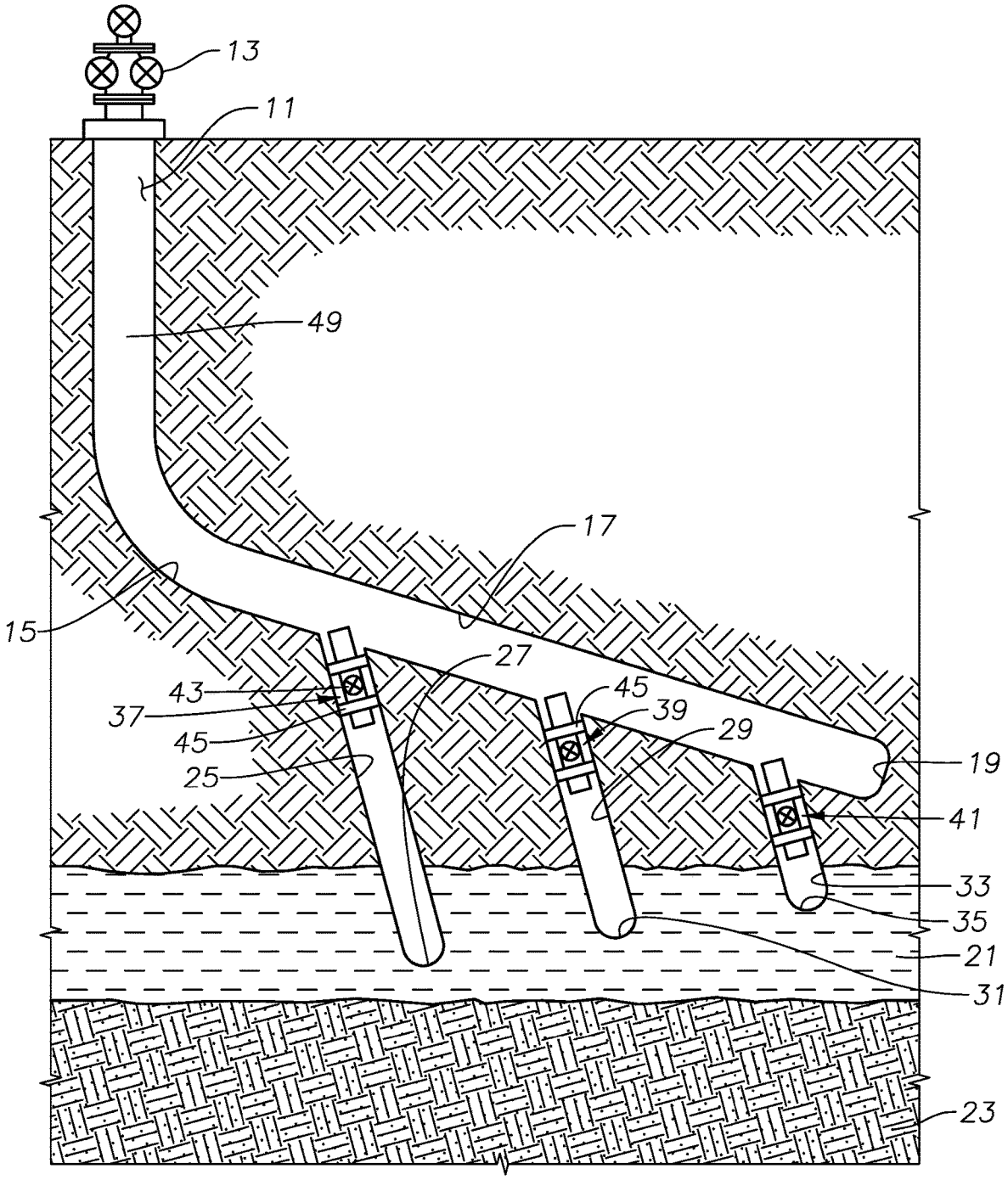
FIG. 2 is a schematic sectional view of the laterals of FIG. 1 with inflow control devices installed.

FIG. 2 shows an inflow control device or valve (ICV) 37 installed in an upper portion of first lateral 25. Second lateral 29 also has an ICV 39, and third lateral 33 has an ICV 41. ICV's 37, 39 and 41 may be identical. Each ICV 37, 39, 41 comprises an assembly with a bore through it containing a valve 43 that opens and closes the bore. Valve 43 could also be a type of a choke that may be adjusted to partially open the bore to meter the flow of well fluid flowing through the bore. In addition, ICV's 37, 39, 41 have one or more packer elements 45 that expand into sealing engagement with the side walls of laterals 25, 29, 33, forcing all well fluid flowing into laterals 25, 29, and 33 to flow through the bores of the ICV's.

Figure 3:
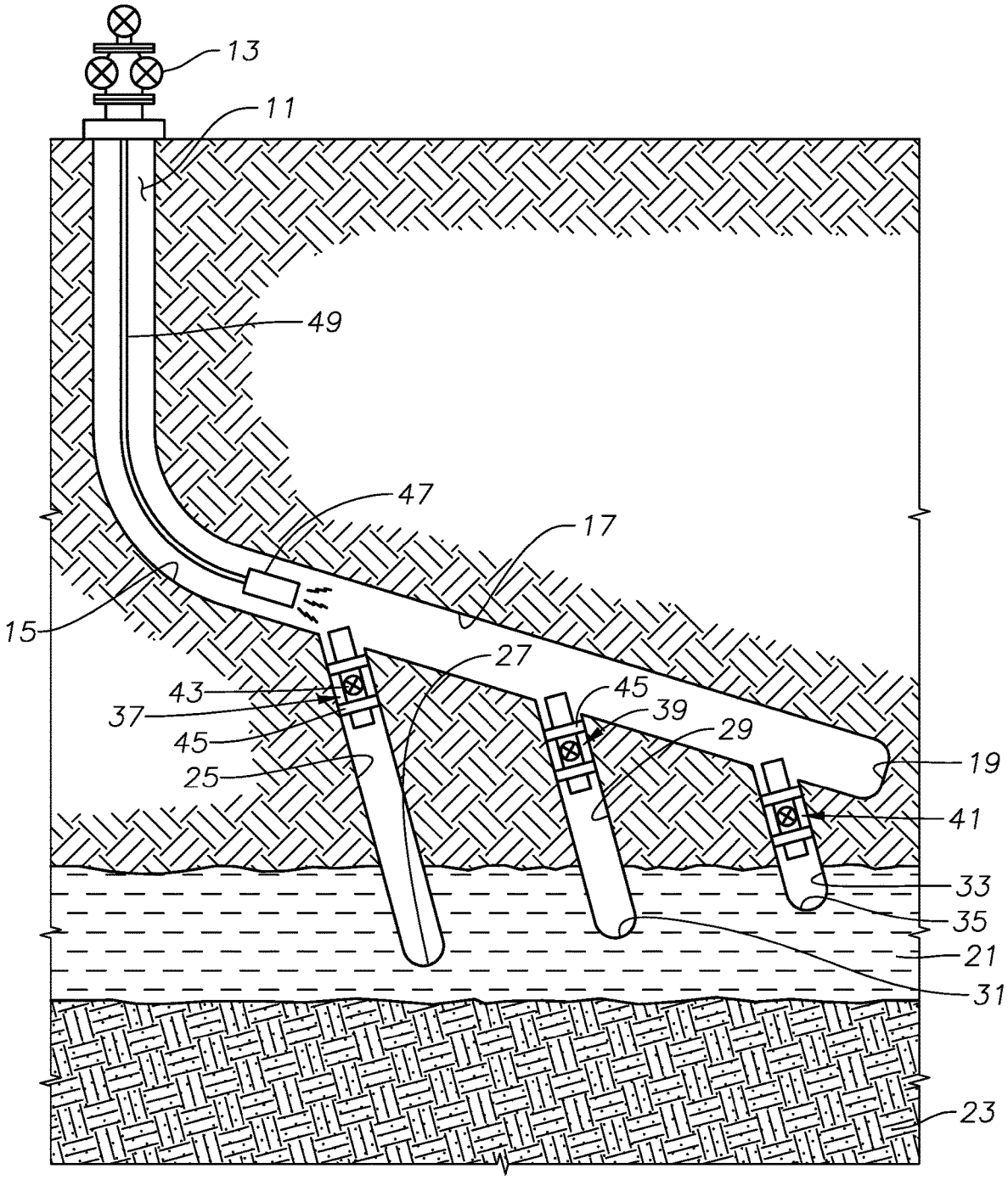
FIG. 3 is a schematic sectional view of the laterals of FIG. 1 with a control tool being lowered on a line into the inclined section of the main bore.

Valves 43 may be electrically powered by a battery. FIG. 3 illustrates a downhole tool 47 lowered on a line 49, which may be a wireline or coiled tubing. Tool 47 has a transmitter that will send a wireless signal a short distance through inclined section 17 for receipt by the closest one of the ICV's 37, 39, 41, which is illustrated to be ICV 37. The signal will actuate valve 43 to open, close, or partially close the bore through ICV 37. The signal may also be used to re-charge the battery of the particular valve 43.

The lowest extent of each opening 27, 31 and 35 will be selected to be initially above any significant level of water within oil bearing zone 21. Valves 43 may be initially fully open, allowing well fluid that is primarily oil to flow through each ICV 37, 39 and 41. The oil from each lateral 25, 29 and 33 flows into inclined section 17 and may commingle as it flows up main bore 11. In this example, no well fluid flows directly into inclined section 17 other than the well fluid flowing through the three laterals 25, 29 and 33.

As the oil is depleted from oil bearing zone 21, water from water bearing zone 23 will encroach upward into oil bearing zone 21. If so, the deepest opening 27 should begin experiencing a higher water content than the water contents of the well fluid flowing through the shallower openings 31, 35. The increased water content could be detected by analyzing the commingled flow at production tree 13. Also, the increased water content in first lateral 25 could separately be detected by the use of a logging tool lowered on a wireline or coiled tubing into inclined section 17. The logging tool could also separately measure the water contents of the well fluid flowing from second and third laterals 29 and 33.

If merited, the operator would then either close or partially close valve 43 in ICV 37 by lowering tool 47 (FIG. 3) to a point close to ICV 37 and sending a signal to ICV 37. If the operator completely closes valve 43 in first lateral ICV 37, all of the well fluid flowing up main bore 11 would be from second and third laterals 29, 33. The operator may choose to partially close valve 43 in first lateral ICV 37, reducing the flow rate of liquid flowing from first lateral 25.

Eventually, water from water bearing zone 23 may begin encroaching into opening 31 in second lateral 29. If so, the water content of well fluid flowing from second lateral 29 would likely be higher than the water content of well fluid flowing from third lateral 33 because of the deeper depth of the lowest extent of second lateral opening 31. The operator may fully or partially close valve 43 in second lateral ICV 39 in the same manner. If closed fully and if first lateral ICV 37 is closed completely, all of the well fluid flowing up wellbore 11 will now be from third lateral 33. As the water content from third lateral 33 increases, the operator may wish to meter the flow through third lateral 33 by adjusting valve 43 in third lateral ICV 41. That adjustment could also be performed by lowering tool 47 (FIG. 3).

In an alternate method, ICV's are not employed to restrict flow in the event of higher water content in the well fluid. Instead, the operator may restrict flow through the first lateral 25 by injecting a sealant into first lateral 25, blocking opening 27. The sealant may be a conventional chemical, such as cement, crosslinked polymers, resins, silicates and the like. If the opening in first lateral 25 comprises a set of perforations, the operator may choose to seal off only a lower portion of those perforations, allowing well fluid to continue flowing through an upper portion of the set of perforations. Alternately, if the operator does not wish to fully close first lateral 25, he could perforate casing in the lateral above the sealant through conventional techniques such as shaped charges or water jetting, creating upper openings in first lateral 25. Well fluid would then flow through the upper openings of first lateral 25. The same alternate procedures could also be followed to restrict flow through opening 31 in second lateral 29.

Providing multiple laterals extending into the same formation to different depths from an inclined wellbore section has advantages. The multiple laterals reduce early water breakthrough in the well by balancing the pressure distribution along the length of the well. Reducing early water breakthrough delays workover operations that may be needed.

The present improvement described is well adapted to carry out the objects and attain the ends and advantages mentioned, as well as others that are inherent. While embodiments of the present description have been given for purposes of disclosure, numerous changes exist in the details of procedures for accomplishing the desired results. These changes will readily suggest themselves to those skilled in the art, and are intended to be encompassed within the spirit of the present disclosure and the scope of the appended claims. For example, although three laterals are shown, only two or more than three could be employed.

What is claimed is:

1. A method of drilling and producing a well having an oil bearing zone overlying a water bearing zone, comprising:

drilling a main bore from a ground surface with an uncased, open hole inclined section inclining downward toward the oil bearing zone, the inclined section having a lower end above the oil bearing zone;

drilling a plurality of uncased, open hole laterals, including first and second laterals, from the inclined section, each extending downward from a junction with the inclined section into the oil bearing zone and each having a lower end in the oil bearing zone above the water bearing zone, the junctions of the laterals with the inclined section being at different depths from the ground surface;

the lower end of the first lateral being at a greater depth from the ground surface than the lower end of the second lateral;

installing a first inflow control device in the first lateral, the first inflow control device comprising a tubular body and a valve in the body, the body having a longitudinal axis coaxial with a longitudinal axis of the first lateral, and where installing the first inflow control device includes sealing the first inflow control device to a sidewall of the open hole, uncased first lateral;

installing a second inflow control device in the uncased, open hole bore of the second lateral, the second inflow control device having a body and a valve, the body of the second inflow control device having a longitudinal axis coaxial with a longitudinal axis of the bore of the second lateral, where installing the second inflow control device comprises sealing the second inflow control device to a sidewall of the to the open hole, uncased second lateral;

flowing well fluid from the oil bearing zone into the open hole, uncased laterals and from the laterals into the open hole, uncased inclined section of the main bore;

where positioning lower end of the inclined section above the oil bearing zone results in all of from well fluid flowing into the inclined section to be coming from the plurality of laterals;

in response to a water content of the well fluid flowing up the main bore increasing due to water from the water bearing zone encroaching into the oil bearing zone, restricting at least a portion of the flow from the first lateral into the inclined section relative to the flow from the second lateral into the inclined section where selectively restricting the flow from the first lateral into the inclined section comprises actuating the valve in the first inflow control device;

then, in response to subsequent water content of the well fluid flowing up the main bore increasing due to water from the water bearing zone continuing to encroach into the oil bearing zone, restricting at least a portion of the flow from the second lateral into the inclined section relative to the flow from other of the laterals; and where restricting the flow from the second lateral into the inclined section comprises actuating the valve in the second inflow control device.

2. The method of claim 1, where drilling first and second laterals comprises inclining each of the laterals at a greater angle relative to horizontal than the inclined section of the main bore.

3. The method of claim 1, where drilling first and second laterals comprises spacing the first and second laterals apart from each other along a length of the inclined section.

4. The method of claim 1, where drilling first and second laterals comprises inclining each of the laterals at an angle in a range from 45 to 90 degrees relative to horizontal.

5. The method of claim 1, where drilling first and second laterals comprises positioning the longitudinal axis of the first lateral and a longitudinal axis of the second lateral in a vertical plane.

6. The method of claim 1, where the junction of the first lateral with the inclined section is uphole from the junction of the second lateral with the inclined section.

7. A method of drilling and producing a well having an oil bearing zone overlying a water bearing zone, comprising:

drilling from a ground surface a main bore with an inclined section that slopes downward from the main bore and extends toward but terminates above the oil bearing zone, the inclined section having an uncased, open hole bore;

drilling a plurality of laterals from the uncased, open hole bore of the inclined section including drilling a first lateral from a first junction with the inclined section downward from the inclined section into the oil bearing zone at a steeper angle than the inclined section, where the first lateral has a lower end in the oil bearing zone at a first selected depth from the ground surface;

where drilling the plurality of laterals includes drilling a second lateral from a second junction with the uncased, open hole bore of the inclined section downward from the inclined section into the oil bearing zone at a steeper angle than the inclined section, where the second lateral has a lower end in the oil bearing zone at a second selected depth from the ground surface that is less than the first selected depth, the second junction being downhole from the first junction, and wherein each of the first and second laterals has an uncased, open hole bore;

installing a first inflow control device in the uncased, open hole bore of the first lateral, the first inflow control device comprising a tubular body and a valve in the body, the body having a longitudinal axis that is coaxial with a longitudinal axis of the first lateral, where installing the first inflow control device comprises sealing an exterior of the body to a sidewall of the uncased, open hole bore of the first lateral;

installing a second inflow control device in the uncased, open hole bore of the second lateral, the second inflow control device comprising a tubular body and a valve in the body of the second inflow control device, the body of the second inflow control device having a longitudinal axis that is coaxial with a longitudinal axis of the second lateral, where installing the second inflow control device in the second lateral comprises sealing an exterior of the body of the second lateral to a sidewall of the uncased, open hole bore of the second lateral;

flowing well fluid from the oil bearing zone into the plurality of laterals, and from the plurality of laterals into the uncased, open hole bore of the inclined section of the main bore;

where terminating the inclined section above the oil bearing zone results in all of the well fluid flowing into the inclined section to be coming from the plurality of laterals;

in response to an increasing water content in the well fluid flowing up the main bore due to water from the water bearing zone encroaching into the oil bearing zone, restricting the flow of well fluid from the first lateral into the inclined section of the main bore relative to the flow of well fluid from the second lateral into the inclined section; where restricting the well fluid flowing from the first lateral comprises adjusting the valve in the first inflow control device; then in response to subsequent increasing water content in the well fluid flowing up the main bore due to water from the water bearing zone encroaching into the oil bearing zone, restricting the flow of well fluid from the second lateral into the inclined section of the main bore relative to the flow of well fluid from the other of the laterals into the inclined section; and restricting the well fluid flowing from the second lateral comprises adjusting the valve in the second inflow control device.

8. The method according to claim 7, where:

adjusting the valve in the first inflow control device comprises lowering a tool on a line into the inclined section of the main bore to a position adjacent the first inflow control device; and transmitting a signal from the tool to the first inflow control device.

9. The method according to claim 7, where drilling first and second laterals comprises inclining each of the laterals at an angle in a range from 45 to 90 degrees relative to horizontal.

10. A method of drilling and producing a well having an oil bearing zone overlying a water bearing zone, comprising:

drilling from a ground surface a main bore with an inclined section having an uncased, open hole bore sloping downward and extending from the main bore toward the oil bearing zone and terminating above the oil bearing zone;

drilling a plurality of laterals, including first, second and third laterals, from the uncased, open hole bore of the inclined section, each of the first, second and third laterals extending downward from the inclined section at a steeper angle than the inclined section into the oil bearing zone, each of the first, second and third laterals having an uncased, open hole bore;

providing in each of the first, second and third laterals a lower end in the oil bearing zone, the lower end in the first lateral being at a greater depth from the ground surface than the lower end in the second lateral, and the lower end in the second lateral being at a greater depth from the ground surface than the lower end in the third lateral;

installing a first inflow control device in the uncased, open hole bore of the first lateral, the first inflow control device having a body and a valve, the body having a longitudinal axis coaxial with a longitudinal axis of the bore of the first lateral, where installing the first inflow control device comprises with an annular first packer, sealing the body to the uncased, open hole bore of the first lateral;

installing a second inflow control device in the uncased, open hole bore of the second lateral, the second inflow control device having a body and a valve, the body of the second inflow control device having a longitudinal axis coaxial with a longitudinal axis of the bore of the second lateral, where installing the second inflow control device comprises with an annular second packer, sealing the body of the second inflow control device to the uncased, open hole bore of the second lateral;

flowing well fluid from the oil bearing zone into the first, second and third laterals and into the uncased, open hole bore of the inclined section of the main bore, where terminating the inclined section above the oil bearing zone results in all of the well fluid flowing into the inclined section to be from the plurality of laterals;

in response to a water content of the well fluid flowing up the main bore due to water from the water bearing zone encroaching into the oil bearing zone, restricting at least a portion of the well fluid flowing from the first lateral by adjusting the valve of the first inflow control device; and in response to a subsequent water content of the well fluid flowing up the main bore due to increasing encroachment of water from the water bearing zone into the oil bearing zone, restricting at least a portion of the well fluid flowing from the second lateral by adjusting the valve of the second inflow control device.

11. The method according to claim 10, where:

drilling the first, second and third laterals from the inclined section comprises drilling the first, second and third laterals from first, second and third junctions, respectively, with the uncased, open hole bore of the inclined section; and the first junction is uphole from the second junction and the second junction is uphole from the third junction.

12. A well configuration for producing a well having an oil bearing zone overlying a water bearing zone, comprising:

a main bore extending from a ground surface and having downward inclined section with an uncased, open hole bore extending toward but having a lower end above the oil bearing zone;

a plurality of laterals, including first and second laterals, each of the plurality of laterals having an uncased, open hole bore extending downward from the inclined section into the oil bearing zone;

a lower end of the first lateral being in the oil bearing zone and a lower end of the second lateral being in the oil bearing zone, the lower end in the first lateral being at a greater depth relative to the ground surface than the lower end in the second lateral, the uncased, open hole bores of the laterals and the placement of the lower end of the inclined section above the oil bearing zone results in all of the well fluid flowing from the oil bearing zone into the uncased, open hole bore of the inclined section of the main bore, the uncased to come from the plurality of laterals; and a first inflow control device in the first lateral, the first inflow control device comprising a tubular body and a valve in the body, the body of the first inflow control device having a longitudinal axis coaxial with a longitudinal axis of the first lateral, and a packer surrounding the body and in sealing engagement with a sidewall of the uncased, open hole bore of the first lateral;

a second inflow control device in the second lateral, the second inflow control device comprising a tubular body and a valve in the body of the second inflow control device, the body of the second inflow control device having a longitudinal axis coaxial with a longitudinal axis of the second lateral, and a packer surrounding the body of the second inflow control device and in sealing engagement with a sidewall of the uncased, open hole bore of the second lateral; and tool means adapted to be lowered into the inclined section for adjusting the valve of the first inflow control device to decrease well fluid flow from the first lateral relative to the second lateral in response to an increase in water content of the well fluid flowing up the inclined section, and in response to a subsequent increase in water content of the well fluid flowing up the inclined section, adjusting the valve of the second inflow control device to decrease well fluid flow from the second lateral relative to the other of the laterals.

13. The configuration of claim 12, where each of the first and second laterals inclines at a greater angle relative to horizontal than the inclined section of the main bore.

14. The configuration of claim 12, where the longitudinal axis of the first lateral and a longitudinal axis of the second lateral are in a vertical plane.

15. The configuration of claim 12, where the first lateral joins the inclined section uphole from the second lateral.

* * * * *